US006718680B2

(12) United States Patent
Roca et al.

(10) Patent No.: US 6,718,680 B2
(45) Date of Patent: Apr. 13, 2004

(54) SEMIAUTOMATIC HANDGUN HAVING MULTIPLE SAFETIES

(76) Inventors: Albert Roca, 3013 231st La. SE. Apt. M305, Issquah, WA (US) 98029; Ray Wilson, 805 Reed St., Asheville, NC (US) 28803

( * ) Notice: Subject to any disclaimer, the term of this patent is extended or adjusted under 35 U.S.C. 154(b) by 261 days.

(21) Appl. No.: 09/811,768

(22) Filed: Mar. 20, 2001

(65) Prior Publication Data

US 2002/0020100 A1 Feb. 21, 2002

Related U.S. Application Data

(60) Provisional application No. 60/190,112, filed on Mar. 20, 2000.

(51) Int. Cl.[7] ..... F41A 17/00

(52) U.S. Cl. ..... 42/70.08; 42/28; 42/29; 42/7; 42/14; 42/34; 89/163; 89/173; 89/184; 89/187.01; 89/27.12

(58) Field of Search ..... 42/70.08, 70.05, 42/70.01, 70.04, 28, 29, 7, 14, 34; 89/163, 162, 173, 184, 187.01, 195, 27.12

(56) References Cited

U.S. PATENT DOCUMENTS 5,426,881 A * 6/1995 Ruger ..... 42/70.08
5,697,178 A * 12/1997 Haskell ..... 42/70.04
6,276,252 B1 * 8/2001 Dionne ..... 42/77
6,354,033 B1 * 3/2002 Findley ..... 42/70.01

* cited by examiner

*Primary Examiner*—J. Woodrow Eldred
(74) *Attorney, Agent, or Firm*—Shoemaker and Mattare

(57) ABSTRACT

A semiautomatic handgun having multiple safeties includes a body made in two halves and a slide which can move lengthwise on a pair of rails. The hammer is cocked by rearward movement of the slide. The trigger, which has purely translation motion, is blocked from behind except when the user is wearing a special magnetic ring on his trigger finger. A decocker mechanism pushes the firing pin forward and slides the sear back, and prevents release of the hammer until the firing pin is blocked. The firing pin is normally blocked by a cup, which prevents the firing pin from moving forward if the gun is dropped. The cup is moved to an inactive position by a release lever only when the trigger is pulled. A safety lock, which is preferably operated by a special tool, prevents the transfer bar from moving. The firing pin block lever is locked in a downward position when the safety is activated. A hammer block bar prevents the hammer from moving when the safety is on.

18 Claims, 15 Drawing Sheets

SEMIAUTOMATIC HANDGUN HAVING MULTIPLE SAFETIES

This application claims priority from provisional patent application No. 60/190112, filed Mar. 20, 2000.

BACKGROUND OF THE INVENTION

This invention relates to a semiautomatic handgun having multiple safeties.

A handgun is designed to be held and fired with one hand. A double action handgun must be first cocked manually, then fired. A semiautomatic weapon does not require manual cocking in between shots, but discharges only one round per trigger pull. A fully automatic weapon fires repeatedly as long as the trigger is pulled. Most modern handguns are semiautomatic.

In a conventional semiautomatic handgun, the hammer is held in its cocked position by a latch called a sear inside the gun, until the sear is displaced by pulling the trigger. The sear automatically moves to its latching position during recocking.

SUMMARY OF THE INVENTION

An object of the invention is to improve gun safety. Other objects are:

- to improve ease of assembly, disassembly and service;
- to prevent accidental firing if the gun is dropped, for example;
- to prevent unauthorized firing is the gun is seized from its owner;
- to permit the user to lock the gun from either side of the gun;
- to prevent someone from disabling the pistol by pushing on the muzzle;
- to permit the user to safely decock the gun;
- to permit replacement of rails when they wear;
- to improve accuracy by eliminating free play between the slide and the body;
- to reduce wear between the slide and the rails;
- to improve the smoothness of the action;
- to improve a inertia activated trigger safety;
- to improve magazine replacement speed;
- to produce a crisp trigger feel;
- to align bore with line of sight, and improve control by reducing height of slide;
- to block unintended linear movement of sear;
- to prevent sear release if the gun is dropped on its muzzle;
- to block the firing pin from moving when the gun is dropped; and
- to prevent unauthorized person from releasing safety lock.

These and other objects are attained by a semiautomatic handgun having multiple safeties, as described below.

BRIEF DESCRIPTION OF THE DRAWINGS

In the accompanying drawings.

DESCRIPTION OF THE PREFERRED EMBODIMENT

Figure 1:
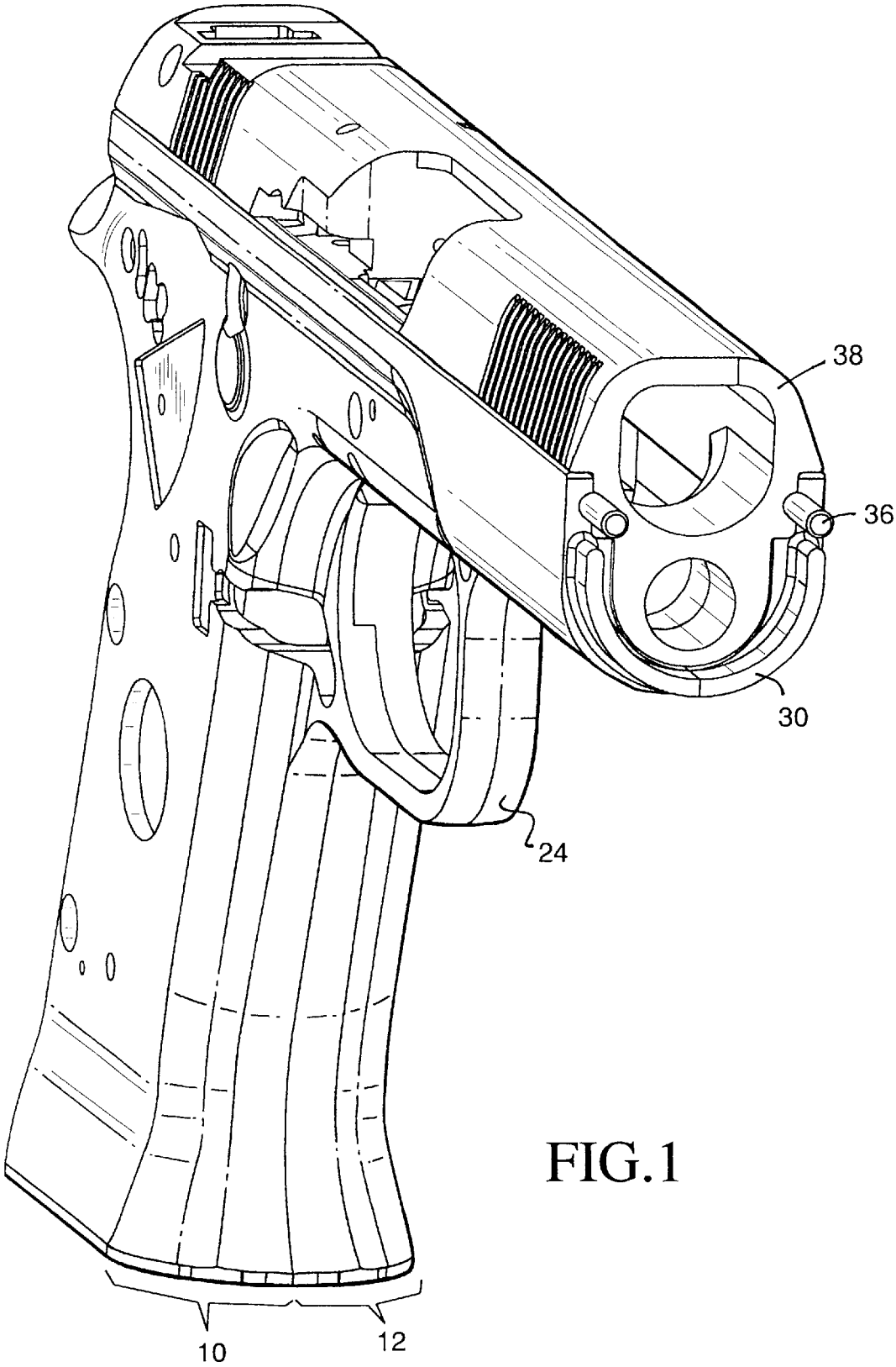
FIG. 1 is a of perspective view of a handgun embodying the invention.
Figure 2:
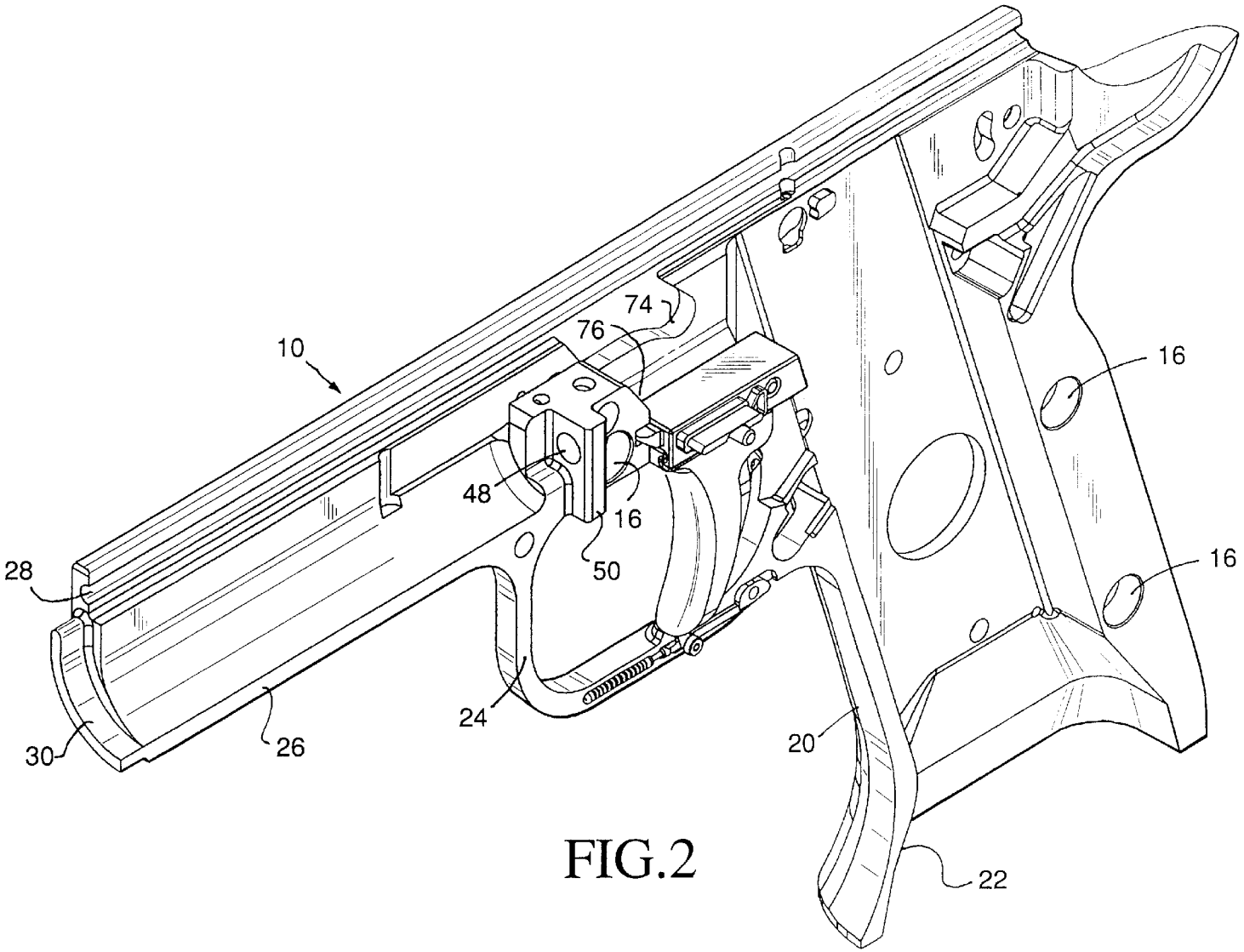
FIG. 2 is a perspective view of the left half of the body of the gun, showing the inside detail.
Figure 3:
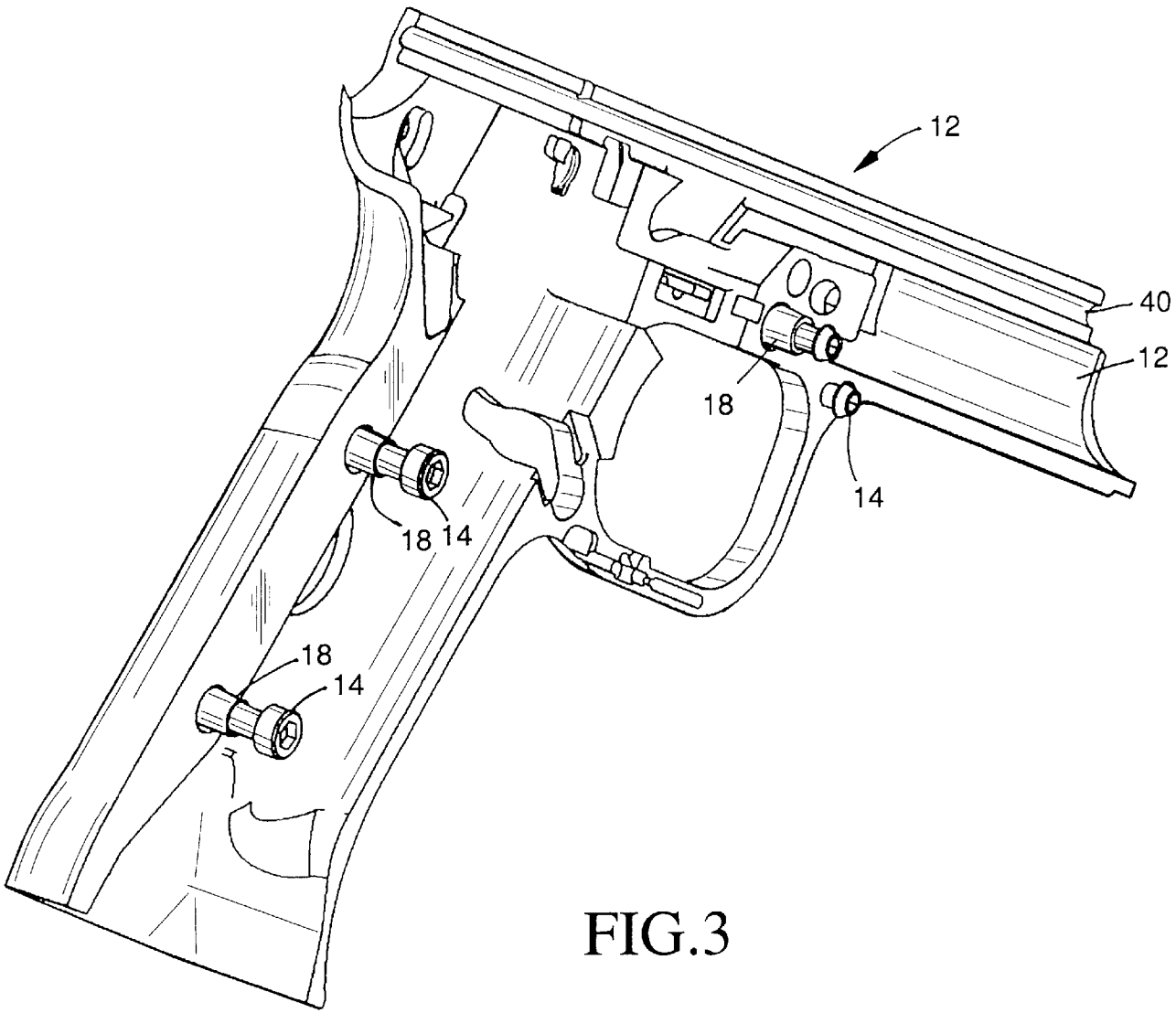
FIG. 3 is a view of internal components of the gun, seen from the right side, including a transfer bar, the sear, and the hammer.
Figure 4:
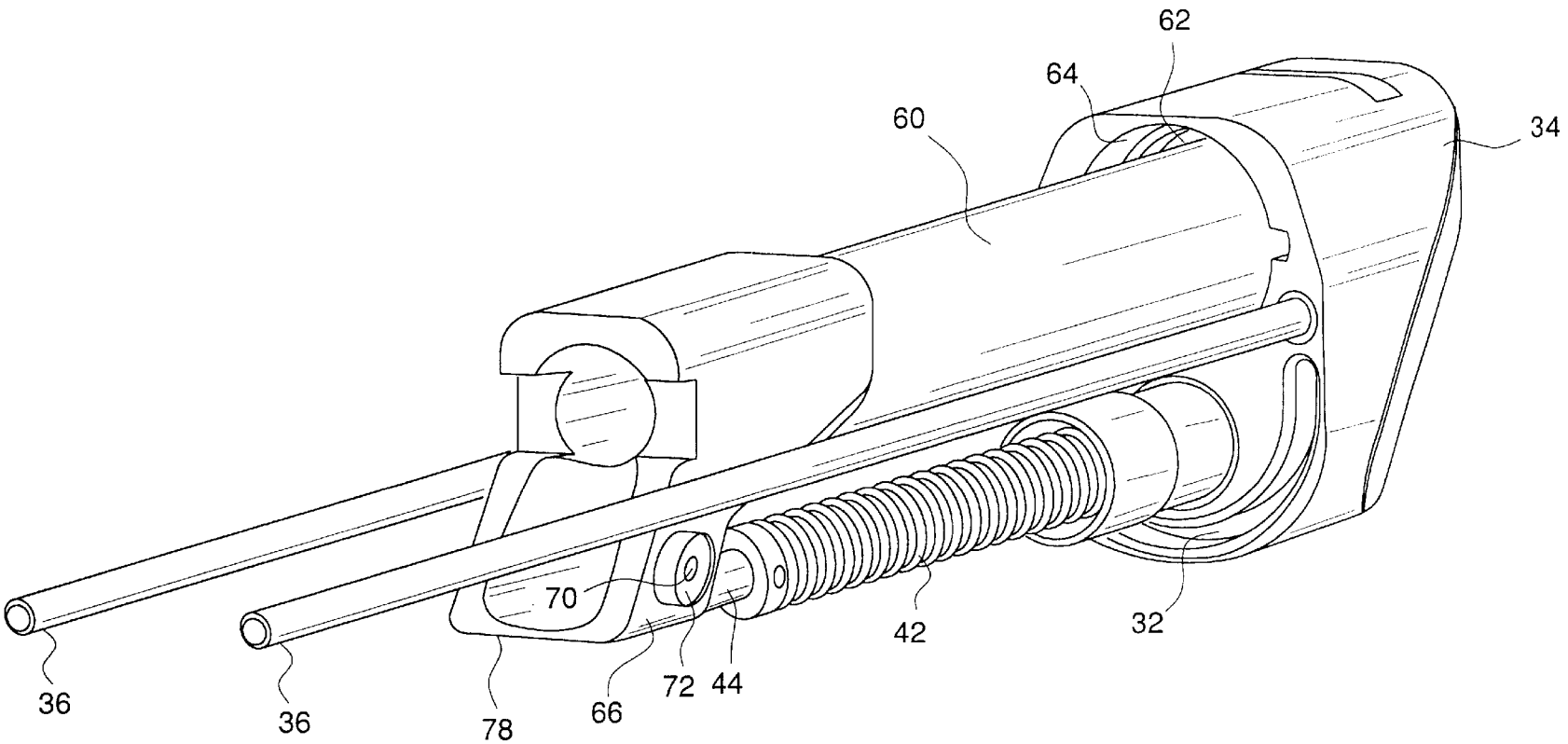
FIG. 4 is a perspective view, from the left rear, of the trigger assembly.
Figure 5:
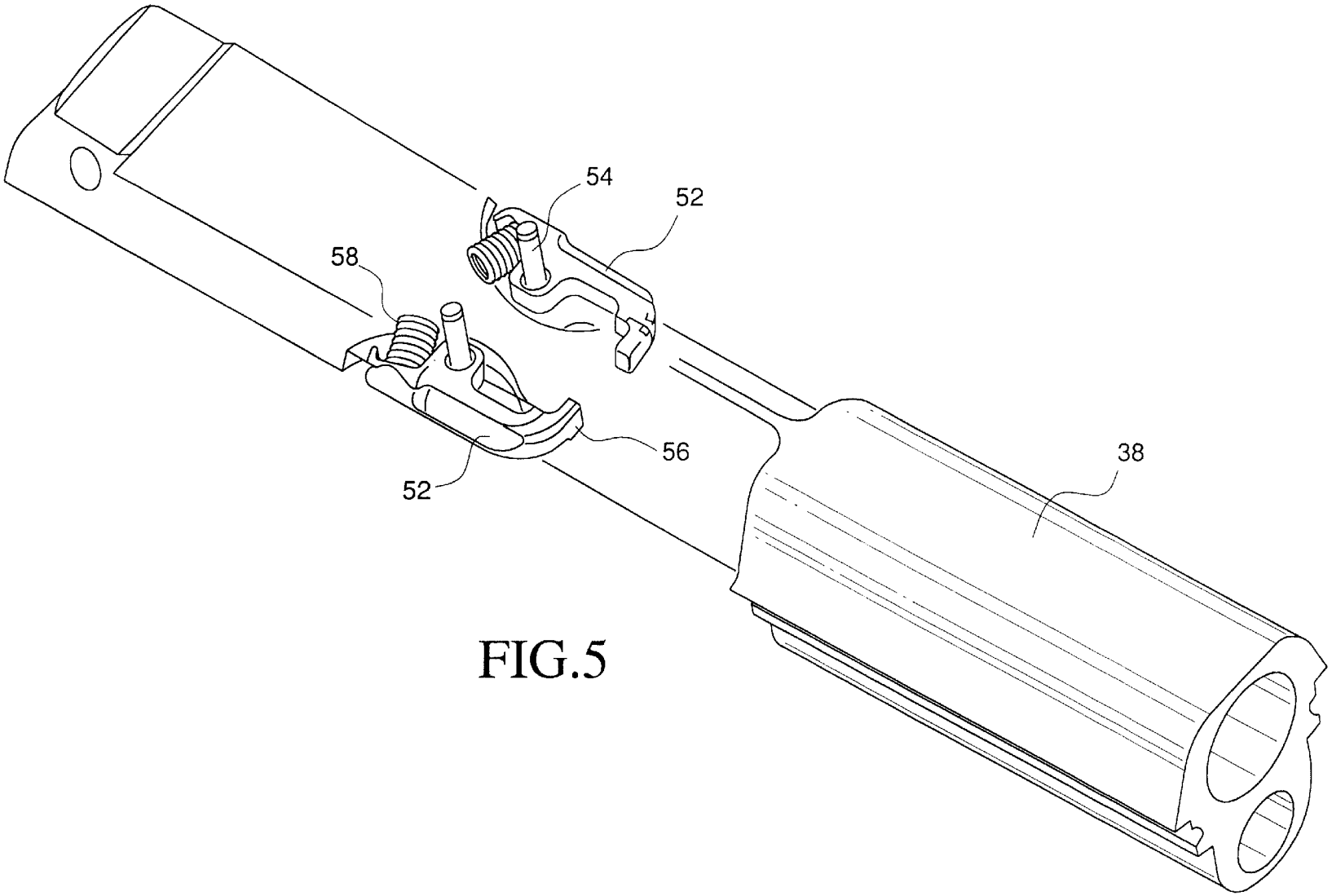
FIG. 5 is a perspective view, looking downward from the right front, of the trigger per se and it biasing spring.
Figure 6:
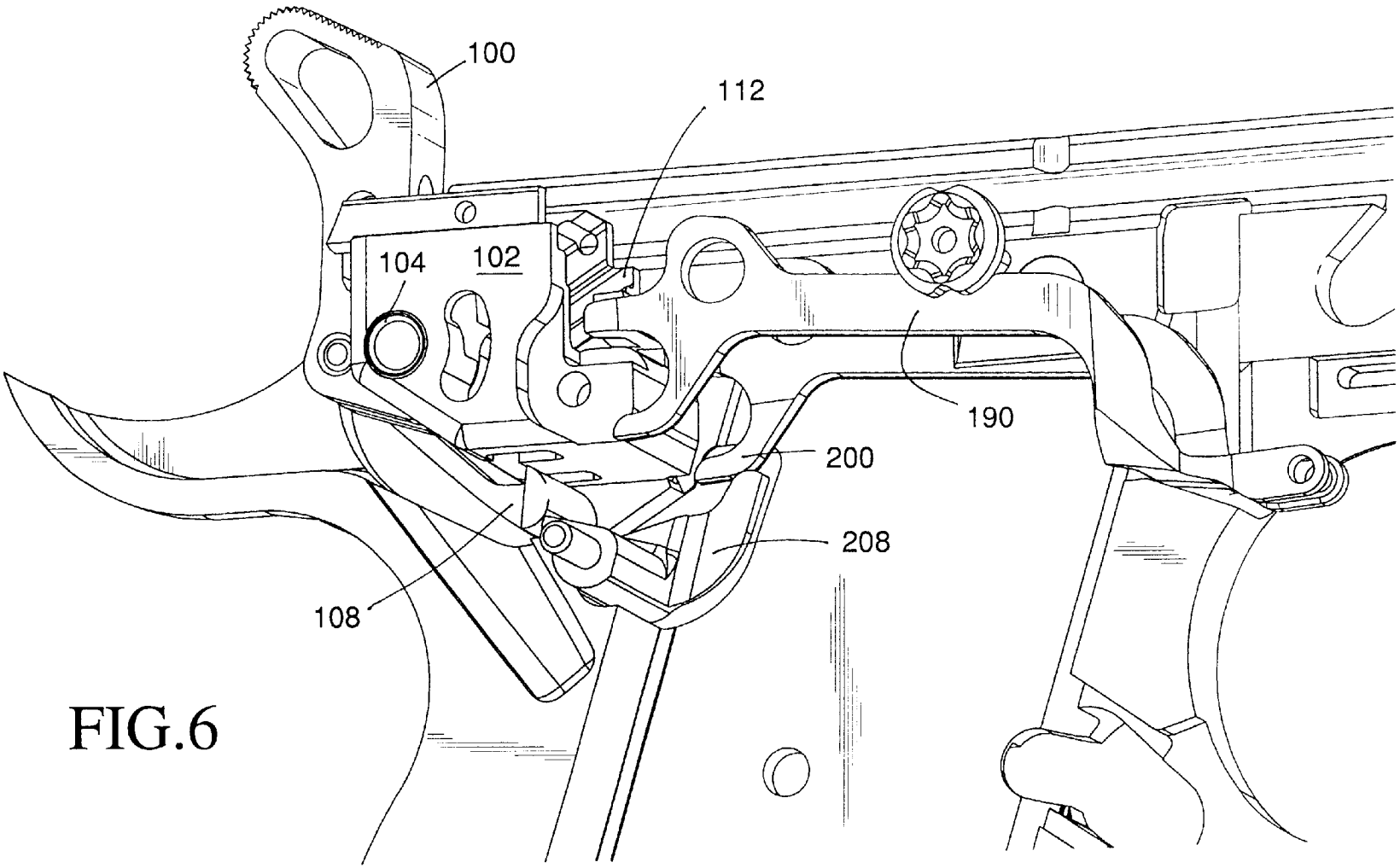
FIG. 6 is a perspective view, looking downward from the right front, of a magnetic trigger safety assembly.
Figure 7:
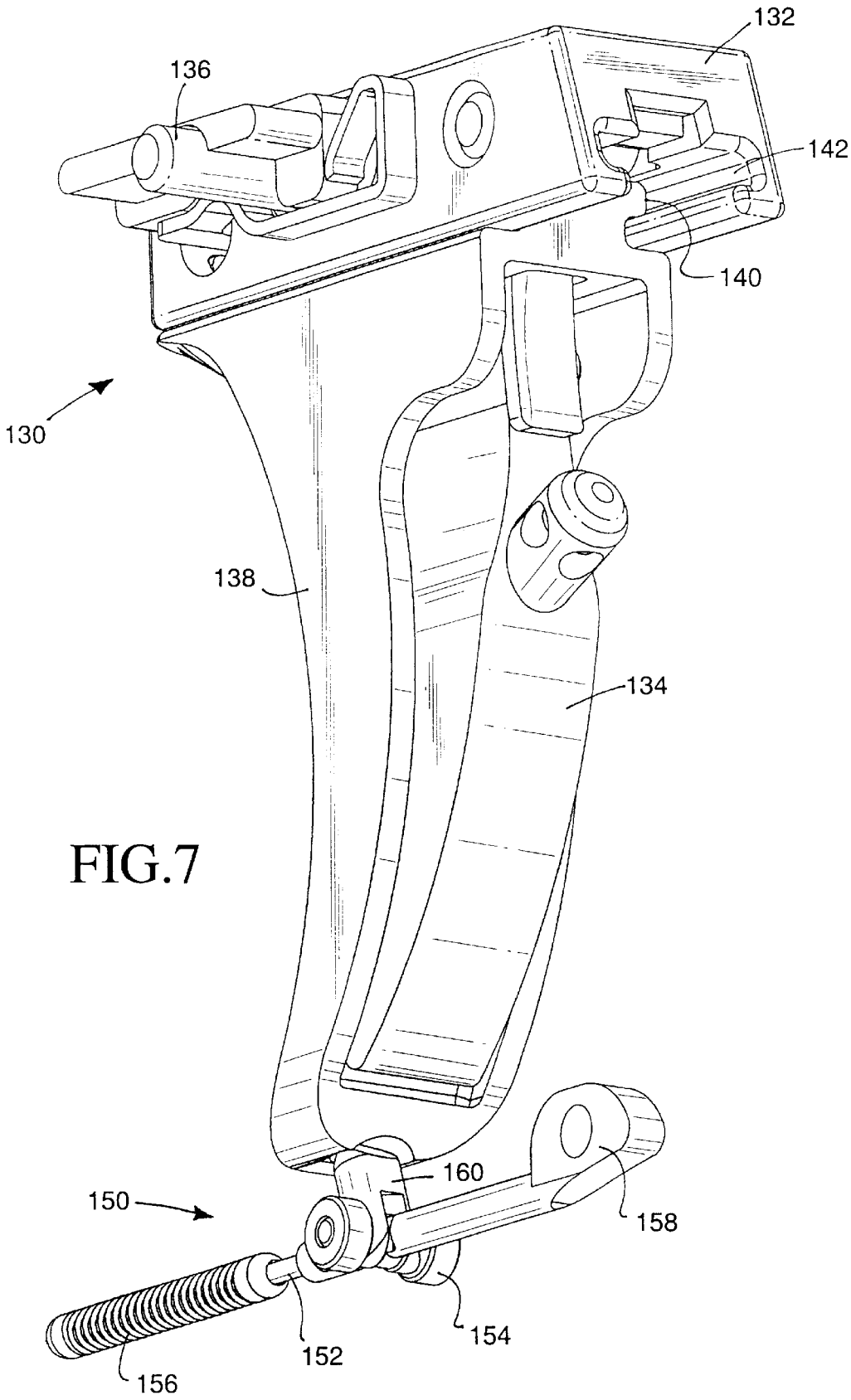
FIG. 7 is a view, looking downward from the right rear, of the hammer, firing pin, and firing pin safety mechanism.
Figure 8:
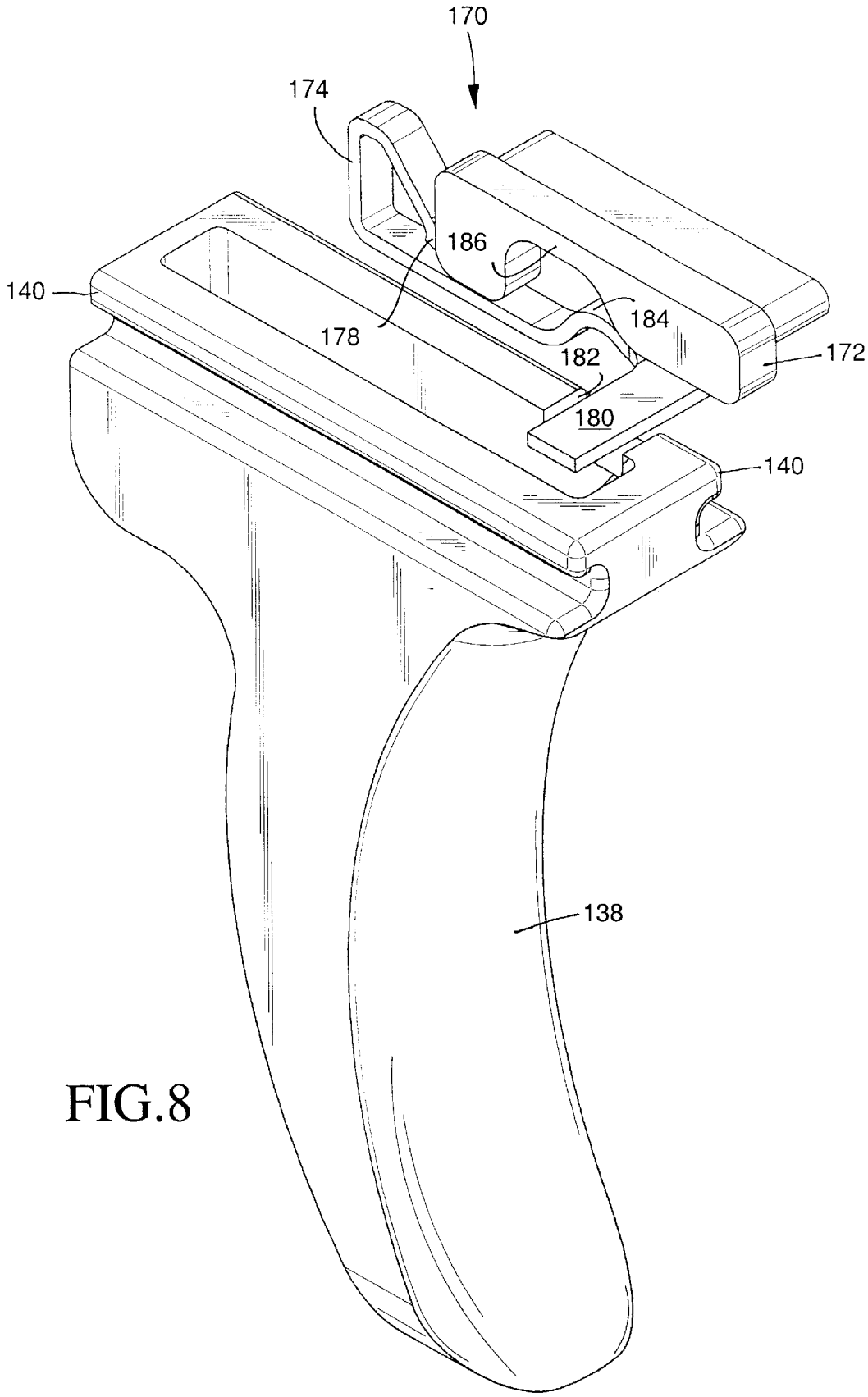
FIG. 8 is a perspective view from the right, showing the transfer bar, the primary safety, the sear, and the hammer housing.
Figure 9:
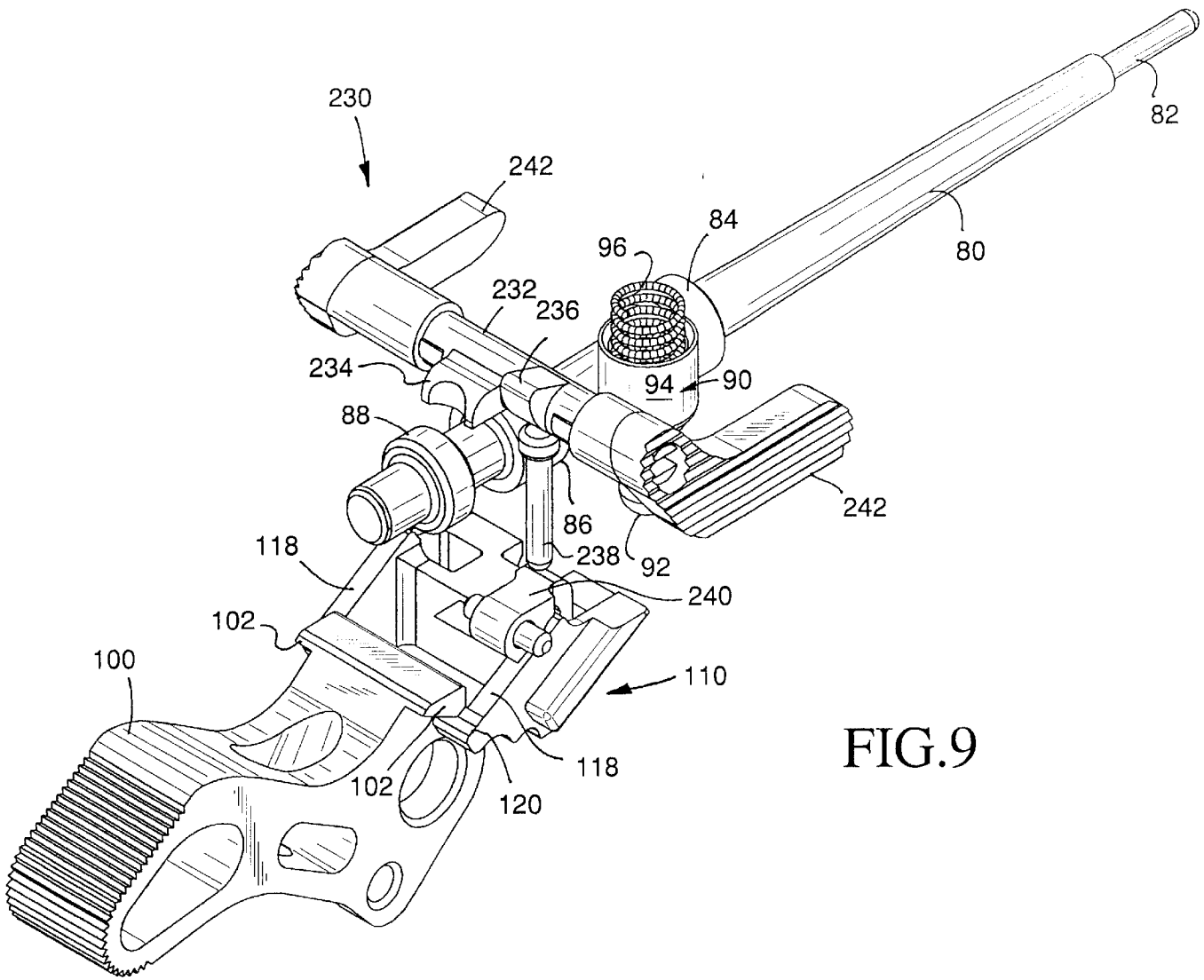
FIG. 9 is a similar view, showing the hammer, the sear, and the transfer bar.
Figure 10:
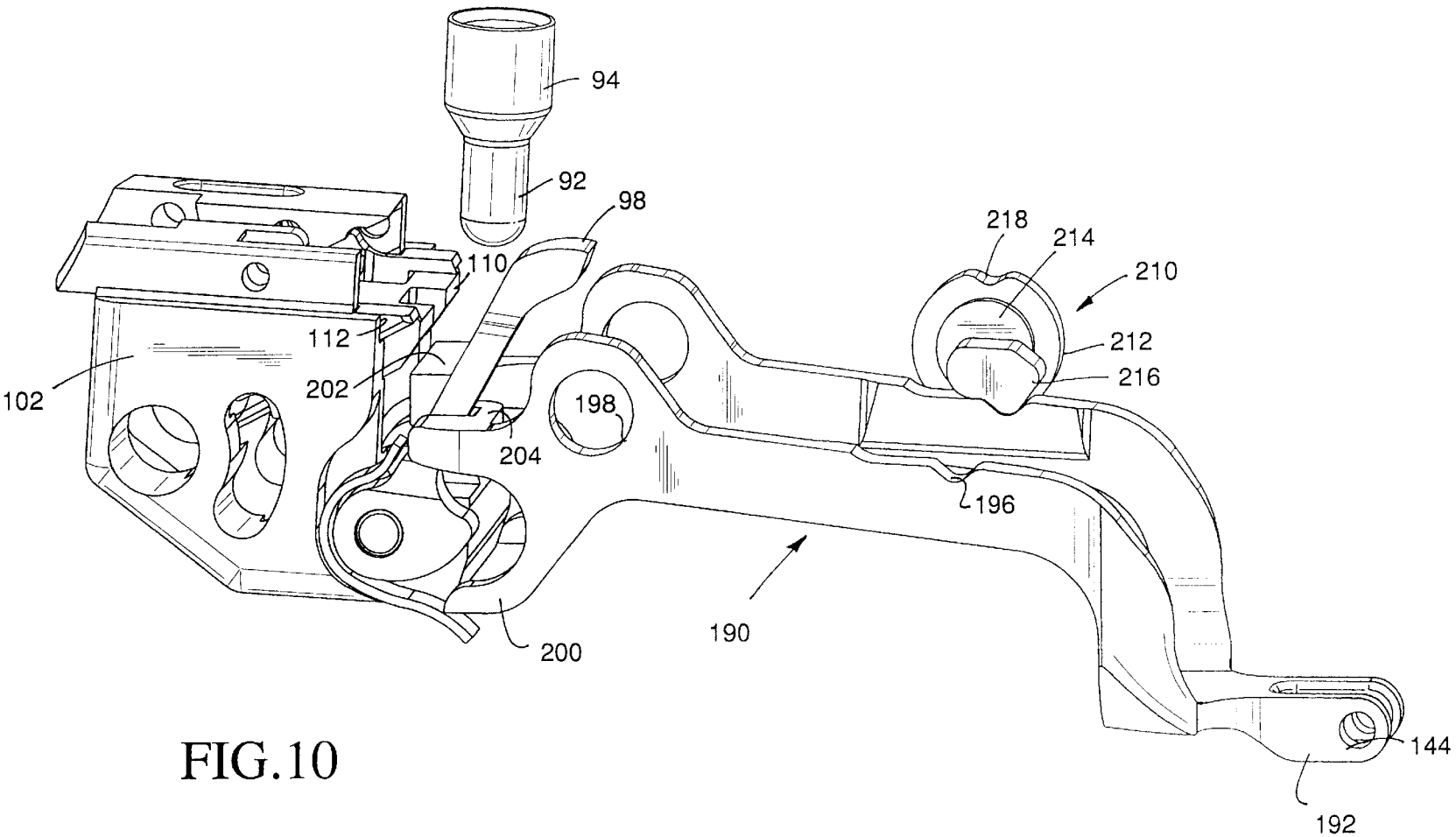
FIG. 10 is a left side view, from above, of the transfer bar, the left primary safety, the sear, and the hammer.
Figure 11:
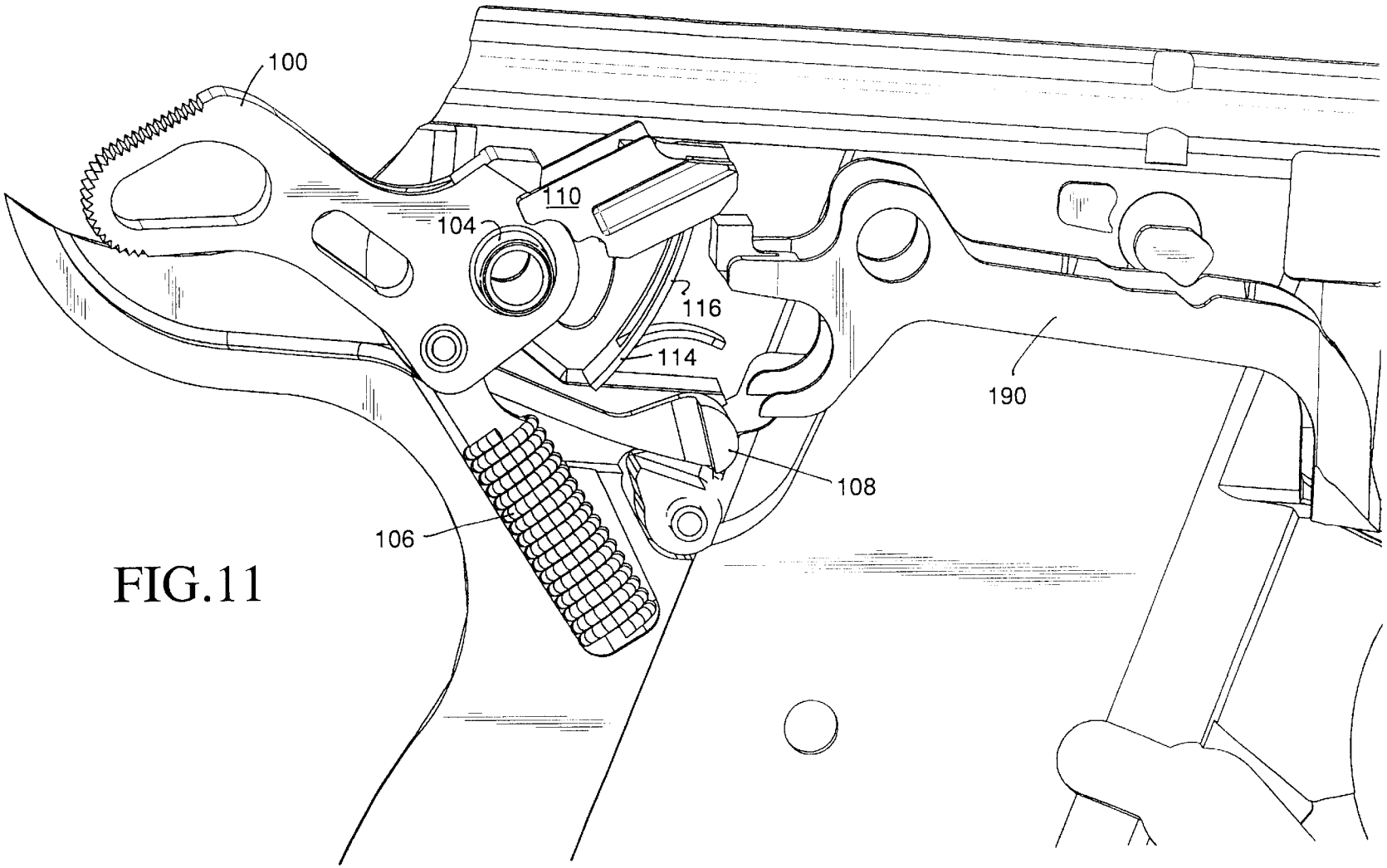
FIG. 11 is a view from the right side, showing the hammer and sear.
Figure 12:
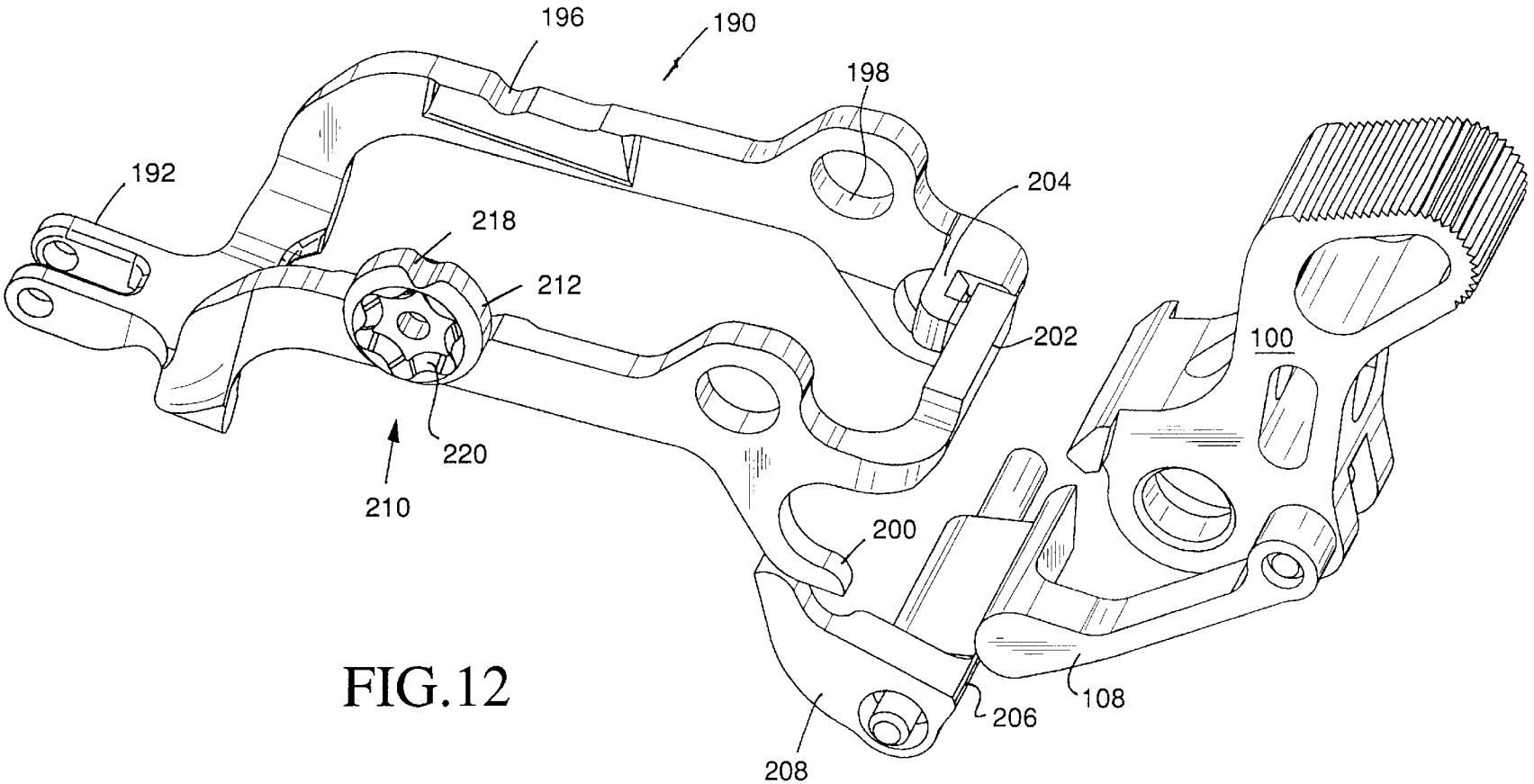
FIG. 12 is a view from the left side, showing the hammer and transfer bar.
Figure 13:
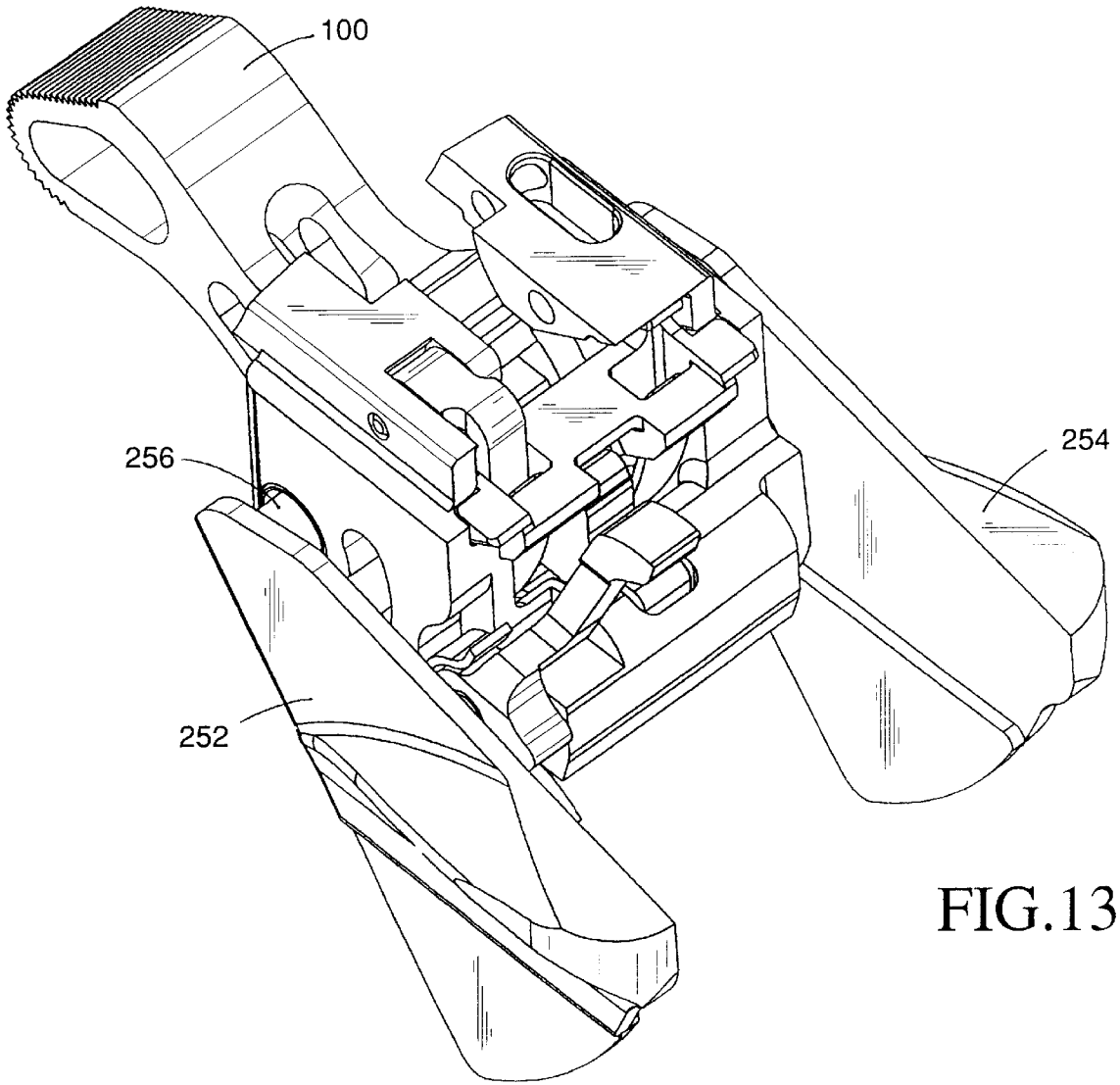
FIG. 13 is a view from above and the right, showing the hammer assembly and safety levers.
Figure 14:
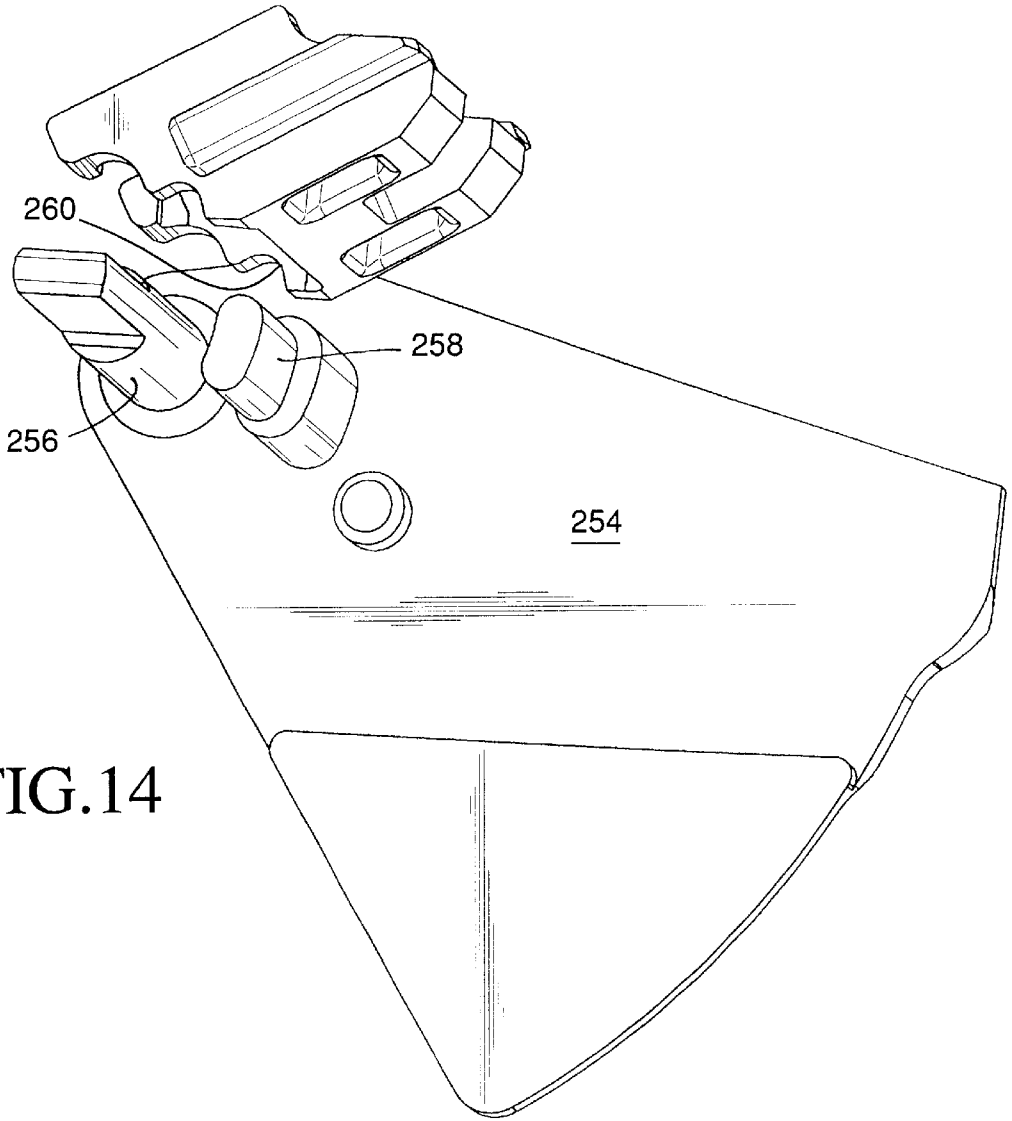
FIG. 14 shows one safety lever in detail.
Figure 15:
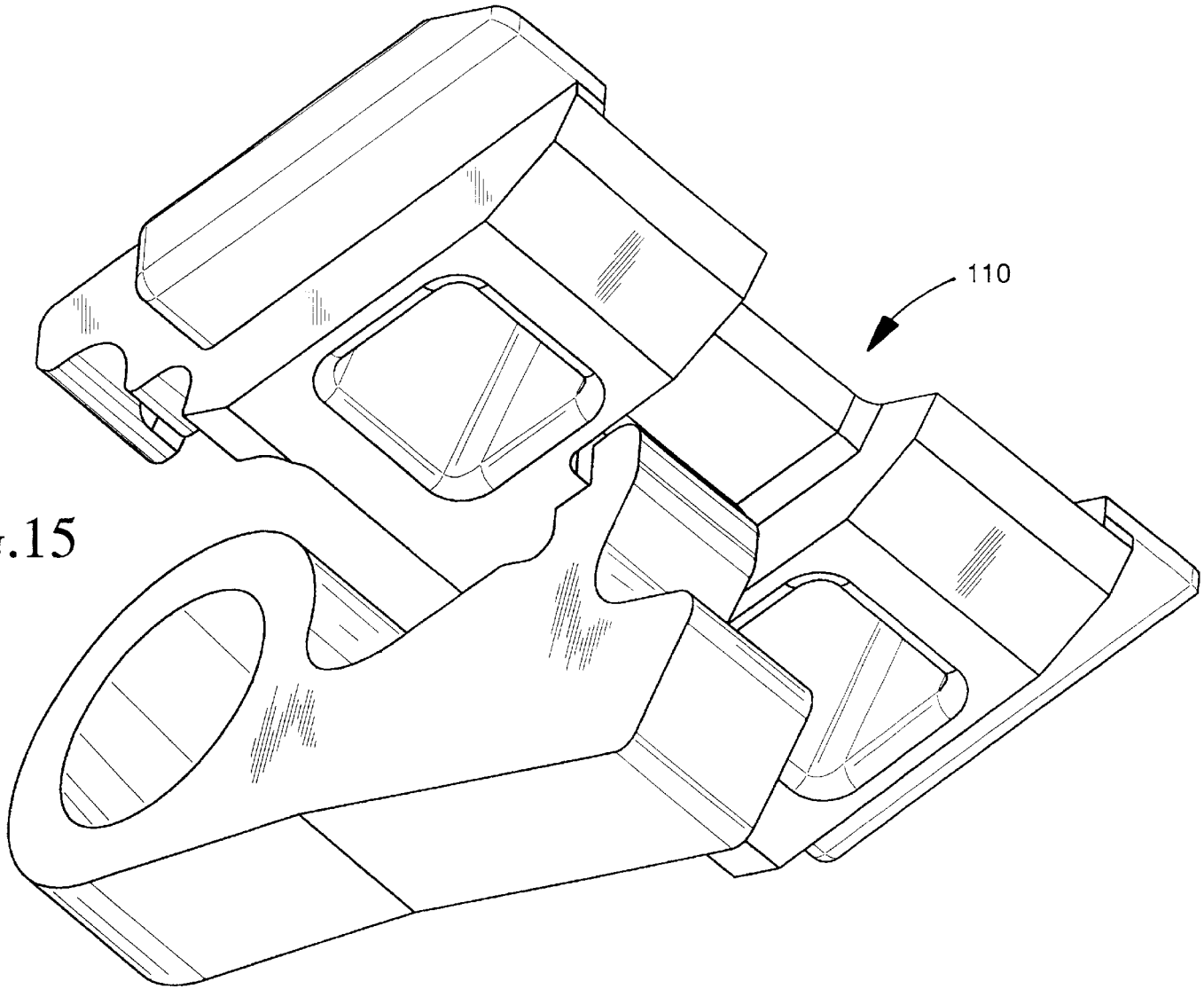
FIG. 15 is a perspective view of the sear.

A pistol embodying the invention comprises a body formed in mating right and left halves 10, 12. The halves are held together by three Allen screws 14 which extend through tapered holes 16 and correspondingly tapered conical bushings 18 which align the halves accurately. Assembled, the body has a hand grip portion 20 defining a magazine well 22, a trigger guard 24, and an action portion 26. A groove 28 is formed in the inner surface of each body half, running parallel to and just below the upper edge of the action. A curved lip 30 extends outward from the front surface of each body half. The lip seats in a groove 32 in the muzzle piece 34. Two rod-shaped rails 36 are secured at their front ends to the muzzle piece. When the muzzle piece is attached to the body, the rods seat in the grooves 28.

A slide 38 is retained in the action portion by the rails 36, which ride in semicircular grooves 40 formed on the sides of the slide. The slide is urged forward by a compression spring 42 surrounding a guide rod 44. The head of the guide rod has a hex recess 46, so that it can be screwed into threaded holes 48 formed in overlapping bosses 50 extending inward from both halves of the body.

The slide supports the gun's barrel 60, which can pivot vertically somewhat about a spherical bushing 62 that is secured to the barrel and turns in a spherical recess 64 in the muzzle piece. The bushing enables the barrel to pivot downward at the rear, after firing, to receive a new round from the magazine. A foot 66 extending downward from the rear of the chamber portion of the barrel has a through hole 68 which receives a pin 70. Small bearings 72 are mounted on the protruding ends of this pin, and the bearings ride in grooves 74 formed on the interior of each body half, to that as the slide is moved rearward, the rear of the barrel is progressively lowered until it is in a position to receive a new round. When the barrel returns to its firing position, its forward motion is arrested by a surface 76 on the body interior that faces the inclined bottom 78 of the foot, precisely fixing the barrel's position with respect to the body.

The firing pin 80, in its firing position, extends toward the rear of the barrel, substantially along the barrel axis. It has a tip 82of reduced diameter, and three enlarged-diameter shoulders 84, 86, 88. A compression spring 90 extends around the front portion of the pin, bearing against the foremost shoulder 84, so as to urge the firing pin rearward. The rearmost shoulder 88 limits rearward movement of the firing pin by engaging a surface on the body. The middle shoulder 86 is provided to interact with a blocking cup 90 that prevents the firing pin from moving under certain conditions described below. The rear end of the pin is in the path of the upper end of the hammer 100. The firing pin is driven forward into an ammunition round in the chamber by the hammer when the trigger is pulled and all safeties are off.

The blocking cup 90 has a lower, small diameter portion 92, and an upper, large diameter portion 94. A coil spring 96 inside the upper portion urges the cup downward toward a safe position where the larger diameter portion lies in the path of the middle shoulder 86 on the firing pin. With the cup in this position, the pin cannot strike the ammunition round, even if the hammer falls against the pin. The cup is lifting by a cup release lever 98 having a pivot pin mounting to the hammer housing.

The hammer 100 is supported in a hammer housing 102 on a pivot pin 104, about which it oscillates between safe and cocked positions. A compression spring 106 urges the hammer forward. The hammer is cocked (moved rearward against its biasing spring) by interaction with the slide. The slide moves rearward from the recoil generated during firing, or it may be moved back by hand to cock the gun. After the hammer is cocked, it is held in its cocked position by a sear 110 which latches against the hammer, preventing it from moving forward. When the trigger is pulled to fire the gun, the sear releases the hammer, allowing the hammer spring to drive the hammer against the firing pin.

The sear 110 has purely sliding movement, along grooves 112 in the hammer housing which are angled upward about 20° from horizontal. The sear is urged forward by a leaf spring 114 having two fingers 116 which rest in square apertures in the sear. The rearwardly-extending arms 118 of the sear have opposed bosses 120 at their ends. The upper boss surfaces lie in the path of the hammer hooks 102, and hold the hammer in its cocked position.

The trigger assembly 130 comprises a trigger housing 132 which is retained between the body halves, a trigger lever 134 mounted for pivoting on a pin 136 extending through the housing, and a hollow shoe 138 which covers the trigger lever. The shoe does not pivot with the lever; rather, it is confined to reciprocating motion in a direction parallel to the barrel. One's finger contacts the shoe, not the lever. The shoe has wings 140 near its top which ride in opposed ways or grooves 142 running fore and aft in the trigger housing.

The trigger lever has a radiused front cam surface 144 that comes in contact with the back surface of the trigger shoe. As the shoe is pulled back, it engages the cam surface and provides varying leverage. An advantage of this construction is that the trigger can be made to have a soft trigger pull without compromising the tension of the springs in the firing mechanism. By altering the geometry and location of the radiused surface of the lever, the length of pull and the force required to release the hammer can be modified without changing any springs in the firing mechanism of the weapon. One can thereby minimize any tendency for hammer follow (the weapon going into an unintended fully automatic firing failure mode).

The trigger has a safety mechanism 150 hidden in a cylindrical recess within the trigger guard 24. This mechanism includes a rod 152 that can slide backwards within the recess, riding on two small rollers 154. The forward end of the rod is surrounded by a light coil spring 156 which biases the rod forward. A large head 158 of a ferro-magnetic material is provided at the rear end of the rod. A tumbler 160 is pinned to the rod in such a way that the tumbler can rotate as the rod moves. This tumbler in its normal resting position (rod forward) extends upward into the path of the tip of the trigger shoe, blocking rearward movement of the trigger. When the rod is retracted, the tumbler is flipped forward and down by contact with the body, out of the path of the tip of the trigger, permitting trigger movement.

The user must wear a magnetic band (not shown) on the middle finger of the shooting hand in order to fire the weapon. When the hand is wrapped around the pistol in a normal holding manner, magnetic attraction from the band pulls the rod hidden in the trigger guard back, freeing the trigger assembly so it can be pulled back to fire the pistol. In the event the pistol is dropped, or wrested from its owner, the internal mechanism returns to its normal position, disabling the pistol. This is so even when the pistol is in ready fire position (hammer cocked).

An inertial safety 170 is provided to prevent the trigger shoe from moving back and accidentally disengaging the hammer if the gun is dropped. The inertial safety includes a sliding block 172 which depresses a portion of a leaf spring 174 that in turn blocks the trigger shoe. The sliding block is made of heavy material such as tungsten, and its movement is ordinarily prevented by the spring tension holding it forward. The left body half has a cutout 176 wherein the sliding block slides forward and back. The spring 174 has at its end a leg 178 that pushes the sliding block forward. The other end of the spring has a leg 180 extending at 90° to the right side of the spring body, and in its normal state, the leg sits just above the trigger shoe. The trigger shoe has a cutout 182 where the leg seats, if the sliding block should move backwards under large inertial forces. The spring has a hump 184 in its middle section and the sliding block has a cutout 186 in its middle section. If the pistol is dropped on its back, the sliding block moves backward and forces the center section of the spring to bend down. This in turn moves the 90 degree leg down into the trigger shoe cutout, blocking trigger movement.

A transfer link 190 connects the trigger assembly and the sear. The transfer link is a closed member of irregular, somewhat rectangular shape, comprising front, left, rear and right sides. With the exception of the rear side, the transfer link is symmetrical about the center plane of the gun. Two fingers 192 extend from the front side of the transfer link. These fingers straddle a portion of the trigger lever, and have aligned holes through which a pin 194 is passed to connect the trigger lever to the link. The right and left sides have detents 196 in their upper surfaces, forward of mid-points of their lengths, and aligned holes 198 at their rears. Rearwardly curved tines 200 extend downward from the rear ends of the right and left sides of the link, below the aligned holes. The rear side of the transfer link is asymmetrical, having an enlargement 202 at its middle, with a forwardly offset extension 204 at its right end. The enlargement pushes against the forward edge of the sear.

When the trigger is pulled, and the gun is cocked, the trigger lever pushes the transfer link rearward, displacing the sear back until the bosses on the sear clear the hammer, releasing it. Because the sear does not rotate, the hammer does not creep as pressure is applied to the trigger: instead, the hammer releases cleanly.

The primary safety is a pair of independent rotary locks 210, one being mounted in each of the halves of the body.

Each lock has a head 212 which can be rotated from outside the gun, a cylindrical bearing portion 214 upon which the lock turns, and a cam 216 extending into the interior of the gun, above one of the detents on the transfer link. The head preferably has two depressions 218 on its circumference. These receive spring-loaded balls (not-shown) situated in holes in the body halves, which define "safe" and "fire" positions. Also, the head has keying means such as an irregular groove 220 on its outer surface, which cannot be turned by conventional tools, or by hand. A correspondingly shaped special tool (not shown) is required to turn either lock, so the gun cannot be unlocked by strangers. Only one of the two locks needs to be in its locked position to disable the gun. When either of the keyed locks is rotated 180° clockwise to its safe position, the weapon is disabled as follows:

1) The transfer bar is held against the frame and the sear hammer housing. The lobe on the lock presses the trigger link bar down into contact with the frame ledge and the sear hammer housing, preventing vertical movement of the link. Simultaneously, the cam lobe seats in a one of the detents in the upper surface of the transfer bar, preventing fore-and-aft movement.

2) Now the trigger cannot be pulled because transfer bar cannot move.

3) Also, the firing pin is blocked, because when either safety is on, the transfer bar depresses the firing pin lever, holding the firing pin cup down, in a position blocking movement of the firing pin. At the same time, the transfer bar engages the firing pin lever and rotates it clockwise so that it becomes trapped between the sear hammer housing and the bottom surface of the transfer bar. This disengages and locks the lever so that it cannot lift the firing pin block cup. Now the firing block cup prevent forward travel of the firing pin.

4) The transfer bar is disengaged from the sear. In its locked position, the transfer link is depressed at its rear, 3° downward from its attachment to the trigger lever. In this position, there can be no direct contact with the sear. Activating the primary safety should be done when the hammer not cocked; however, the hammer is locked in place even without sear disengagement, in the event that the locking action takes place with the hammer cocked. The hammer slide bar has gone past the hammer block bar and the only thing holding the hammer back is its engagement with the sear. This does not mean that the weapon is in an unsafe state, because even if the decocker is activated to release the hammer from its cocked position, the decocker has the added feature that it sinks and traps the firing pin past the firing pin stop. If the decocker mechanism should fail during the decock action, and even if the hammer strikes the firing pin directly, the firing pin cannot move forward because the firing pin cup is blocking it, and the firing pin cup cannot be disabled because the transfer bar locks the firing pin block cup lever downward. The firing pin block cup lever lifts the firing pin block cup so that the firing pin can travel forward to strike the primer in the ammunition round. A more detailed explanation of the decocker mechanism appears further below.

5) Additionally, the hammer cannot be cocked. As the transfer bar is pushed down to its locked position by the safety lock lobe(s), it pivots the hammer block bar clockwise (as seen from the right), thus blocking the forward slide movement of the hammer slide bar. The slide bar is attached to the hammer with the hammer strut pin, and always moves with the hammer through its cycling action. When the movement of the hammer slide bar is blocked, the hammer cannot move.

6) The slide cannot be racked or opened. The slide bears rearwardly against the hammer. So, once the hammer is locked in place, the slide cannot be racked backwards to cock the pistol, and therefore the whole upper assembly is locked in place and the pistol cannot be opened, either to load or unload it. Thus, even if a bullet is left in the barrel chamber, once the external locks have been rotated to their lockup position the pistol is completely closed and cannot be opened or fired.

7) The locks can only be disengaged with a special keyed tool. As mentioned, the external surface of the safety locks preferably have a complex shape that requires a custom tool or key to be inserted into it to unlock or rotate them.

8) Overriding the safety mechanism by force damages internal parts, disabling the pistol. Once the weapon is locked, applying enough force to the trigger to get it to travel backwards will bend or break the transfer bar and bend the levers that connect to it, and render the weapon useless. Likewise, forcing the hammer back will damage and disable the weapon.

An additional safety feature of the gun is its decocking mechanism 230. The decocker has lug surfaces which engage the firing pin to disable it. The decocker also allows the hammer to fall from its single action "ready" to "fire" position without firing the pistol. Accidental discharge is also prevented, because even if the pistol is dropped while cocked, inertial driving of the firing pin cannot occur because the firing pin is trapped.

The decocker 230 includes a shaft 232 that has a lug 234 and a cam 236. The function of the lug is to engage and push the center section of the firing pin past the firing pin stop and to trap it against the firing pin block cup. The function of the cam is to push a spring loaded pin 238 into contact with a swivel 240 that is provided on the sear. When the decocker shaft is manually rotated upward about 90°, the cam pushes the pin down, forcing the sear to travel back thus disengaging the hammer hooks. Note that the firing pin sinks past the firing pin stop and trapped before the hammer is released. Should the decocker mechanism fail, the geometry of the parts nevertheless maintains a safe condition, because if the hammer should fall against the firing pin during the activation of the decocker, a trapped firing pin results.

Since the invention is subject to modifications and variations, it is intended that the foregoing description and the accompanying drawings shall be interpreted as only illustrative of the invention defined by the following claims.

We claim:

1. A handgun comprising mating right and left body halves, fasteners for holding the right and left halves together along a mating plane, a slide contained between said left and right halves, and adapted to slide fore and aft between said halves, a muzzle piece secured to the slide, a groove formed in the mating surface of each body half, said grooves being parallel, a pair of rails, each secured at its front end to the muzzle piece and adapted to seat in a respective one of said grooves, said slide having parallel grooves one either side in which said rails are seated.

2. The invention of claim 1 wherein said halves have aligned tapered holes, said fasteners are a plurality screws which pass through said aligned holes and nuts adapted to receive threaded portions of said screws, and further comprising a corresponding plurality of pairs of tapered bushings, each of said bushings being received in a corresponding one of said tapered holes.

3. The invention of claim 1 further comprising a barrel mounted within the slide and supported therein by a bushing adapted to permit limited vertical pivoting of the barrel with respect to the slide during chambering of a round in the barrel.

4. A handgun comprising mating right and left body halves, fasteners for holding the right and left halves together along a mating plane, a slide contained between said left and right halves, and adapted to slide fore and aft between said halves, wherein the barrel has a chamber portion at its rear, and a foot extending downward from the rear of the chamber portion, bearings supported on said foot, grooves formed on the mating surfaces of the halves, and adapted to receive said bearings and to guide the rear of the barrel so that as the slide is moved rearward, the rear of the barrel is progressively lowered until it is in a position to receive a new round.

5. The invention of claim 4 wherein the foot has an inclined surface adapted to engage a corresponding surface on at least one of the halves to precisely fix the position of the barrel when the barrel is fully advanced.

6. A handgun comprising mating right and left body halves, fasteners for holding the right and left halves together along a mating plane, a slide contained between said left and right halves, and adapted to slide fore and aft between said halves, a firing pin extending toward the rear of the barrel, substantially along the barrel axis, said firing pin comprising a front portion having a tip of reduced diameter, and a rear portion having three enlarged-diameter shoulders, a compression spring extending around the front portion of the pin, bearing against the foremost shoulder, so as to urge the firing pin rearward, the rearmost shoulder limiting rearward movement of the firing pin by engaging a surface on the body, and the middle shoulder interacting with a means for selectively blocking the firing pin from forward movement.

7. The invention of claim 6 wherein the blocking means is a blocking cup having a lower, small diameter portion and an upper, large diameter portion, and further comprising a coil spring inside the upper portion urging the cup downward toward a safe position where the larger diameter portion lies in the path of the middle shoulder on the firing pin, and a cup release lever for moving the cup upward against the action of the coil spring to permit the firing pin to move forward into the round.

8. A handgun comprising mating right and left body halves;

fasteners for holding the right and left halves together along a mating plane;

a slide contained between said left and right halves, and adapted to slide fore and aft between said halves; and a hammer and sear assembly comprising a housing adapted to be secured between said halves, a hammer supported in said hammer housing on a pivot pin, about which the hammer oscillates between safe and cocked positions, a spring urging the hammer forward from its cocked position toward a firing pin, a sear for latching the hammer in its cocked position, preventing it from moving forward, and means operated by a trigger to disengage the sear from the hammer, allowing the spring to drive the hammer forward into the firing pin, wherein the sear is mounted for rectilinear sliding movement within the hammer housing.

9. The invention of claim 8 wherein the sear rides along grooves in the hammer housing, said grooves being angled upward about 20° with respect to the firing direction of the gun.

10. The invention of claim 8 further comprising a leaf spring for biasing the sear forward, the leaf spring having two fingers which rest in square apertures in the sear and a portion which bears against the hammer housing.

11. A handgun comprising mating right and left body halves;

fasteners for holding the right and left halves together along a mating plane;

a slide contained between said left and right halves, and adapted to slide fore and aft between said halves; and a trigger housing retained between the body halves, a trigger lever mounted for pivoting on a pin extending through the housing, and a hollow shoe covering the trigger lever, said shoe having only reciprocating motion in a direction parallel to the barrel.

12. The invention of claim 11 wherein the shoe has wings near its top, said wings riding in opposed ways or grooves formed in the trigger housing.

13. The invention of claim 11 wherein the trigger lever has a radiused front cam surface contacting the back surface of the trigger shoe whereby, as the shoe is pulled back, it engages said cam surface and provides varying leverage.

14. The invention of claim 11 further comprising an inertial safety for preventing the trigger shoe from moving back and accidentally discharging the gun if it is dropped, said inertial safety including a leaf spring having a portion adapted to block rearward movement of the trigger shoe, a sliding block made of a heavy material, and adapted to slide rearward in a recess in the gun halves to a position in which it depresses said portion so as the block the trigger shoe.

15. The invention of claim 8 wherein the means for disengaging the sear from the hammer is a transfer link connecting the trigger assembly to the sear, and further comprising a primary safety for preventing movement of said transfer link, said primary safety comprising at least one rotary member having a head which can be rotated from outside the gun, a cylindrical bearing portion upon which the lock turns, and a cam extending into the interior of the gun, said cam having a lobe portion for engaging said transfer link and preventing it from moving.

16. The invention of claim 15 wherein said primary safety head has an irregular groove adapted to receive a corresponding special tool, whereby the primary safety cannot be operated by an unauthorized person.

17. The invention of claim 8 further comprising a decocking mechanism preventing firing pin movement while decocking the gun, said mechanism comprising an a shaft extending transversely through the gun above the firing pin, means outside the gun for rotating said shaft, a lug surface extending from the shaft within the gun adapted to engage a shoulder on the firing pin to limit its forward movement.

18. The invention of claim 17 further comprising a lever mounted in the hammer housing and adapted to release the sear, a pin for pushing the lever toward its sear-releasing position, and a cam on the decocker shaft for pushing the pin toward the lever.

* * * * *